United States Patent [19]

Umemura et al.

[11] Patent Number: 4,487,627

[45] Date of Patent: Dec. 11, 1984

[54] METHOD FOR PREPARING FERROMAGNETIC METAL PARTICLES

[75] Inventors: Shizuo Umemura; Tatsuji Kitamoto, both of Kanagawa, Japan

[73] Assignee: Fuji Photo Film Co., Ltd., Kanagawa, Japan

[21] Appl. No.: 547,618

[22] Filed: Nov. 1, 1983

[30] Foreign Application Priority Data

Nov. 1, 1982 [JP] Japan ..... 57-192099

[51] Int. Cl.[3] ..... B22F 9/22

[52] U.S. Cl. ..... 75/0.5 BA; 148/105

[58] Field of Search ..... 75/0.5 AA, 0.5 BA; 148/105

[56] References Cited

U.S. PATENT DOCUMENTS

| | | | |
|---|---|---|---|
| 3,598,568 | 8/1971 | Klomp et al. | 75/0.5 AA |
| 3,607,219 | 9/1971 | Vander Giessen et al. | 148/105 |
| 3,607,220 | 9/1971 | Vander Giessen et al. | 75/0.5 AA |
| 3,634,063 | 1/1972 | Hwang | 148/105 |
| 3,702,270 | 11/1972 | Kawasaki et al. | 75/0.5 BA |
| 4,347,291 | 8/1982 | Tokuoka | 75/0.5 AA |
| 4,406,694 | 9/1983 | Mishima et al. | 75/0.5 BA |

FOREIGN PATENT DOCUMENTS

| | | | |
|---|---|---|---|
| 57-63605 | 4/1982 | Japan | 75/0.5 BA |
| 58-77504 | 5/1983 | Japan | 75/0.5 BA |
| 2063845 | 6/1981 | United Kingdom | 75/0.5 BA |

*Primary Examiner*—John P. Sheehan

*Attorney, Agent, or Firm*—Sughrue, Mion, Zinn, Macpeak and Seas

[57] ABSTRACT

A method for preparing ferromagnetic metal particles is disclosed. The method involves dehydrating oxyhydroxide particles comprised mainly of iron in a nonreducing gas under heating at a temperature of not more than 500° C. to form oxide particles, providing silicon compounds on the surface of oxide particles, and reducing the oxide particles in a reducing gas under heating. The ferromagnetic metal particles provided have good acicular shape and a large specific surface area.

10 Claims, No Drawings

METHOD FOR PREPARING FERROMAGNETIC METAL PARTICLES

FIELD OF THE INVENTION

The present invention relates to a method for preparing ferromagnetic metal particles.

BACKGROUND OF THE INVENTION

A magnetic recording medium using ferromagnetic metal particles with high saturation magnetization ($\sigma s$) and high coercive force (Hc) has been recently researched and developed to improve recording density and reproducing output.

The following methods for preparing ferromagnetic metal particles have hitherto been known:

(1) an organic acid salt of ferromagnetic metal is hydrolyzed and then reduced with a reducing gas (see Japanese Patent Publication Nos. 11412/61, 22230/61, 14809/63, 3807/64, 8026/65, 8027/65, 15167/65, 12096/66, 24032/67, 3221/68, 22394/68, 29268/68, 4471/69, 27942/69, 38755/71, 4286/72, 38417/72, 41158/72 and 29280/73, Japanese Patent application (OPI) No. 35823/72 (the term "OPI" as used herein refers to a "published unexamined Japanese patent application"), and U.S. Pat. Nos. 3,186,829 and 3,190,748);

(2) an acicular oxyhydroxide of a ferromagnetic metal, an acicular oxyhydroxide of a ferromagnetic metal and another metal, or acicular iron oxide derived from these oxyhdroxides is reduced with a reducing gas (see Japanese Patent Publication Nos. 3862/60, 11520/62, 20335/64, 20939/64, 24833/71, 29706/72, 39477/72, 24952/73 and 7313/74, Japanese Patent application (OPI) Nos. 7153/71, 38523/72, 79153/73, 82395/73 and 97738/74, and U.S. Pat. Nos. 3,598,568, 3,634,063, 3,607,219, 3,607,220 and 3,702,270);

(3) a metal carbonyl compound is thermally decomposed (see Japanese Patent Publication Nos. 1004/64, 3415/65, 16968/70 and 26799/74 and U.S. Pat. Nos. 2,983,997, 3,172,776, 3,200,007 and 3,228,882);

(4) a ferromagnetic metal is vaporized in a low-pressure inert gas (see Japanese Patent Publication Nos. 25620/71, 4131/74, 27718/72, 15320/74 and 18160/74 and Japanese Patent application (OPI) Nos. 25662/73, 25663/73, 25664/73, 25665/73, 31166/73, 55400/73 and 81092/73);

(5) a metal salt capable of forming a ferromagnetic material in aqueous solution is reduced with a reducing material (e.g., borohydride compound, hypophosphite or hydrazine) to form ferromagnetic particles (see Japanese Patent Publication Nos. 20520/63, 26555/63, 20116/68, 9869/70, 14934/70, 7820/72, 16052/72 and 41718/72, Japanese Patent application (OPI) Nos. 1363/72, 42252/72, 42253/72, 44194/73, 79754/73 and 82396/73, U.S. Pat. Nos. 3,607,218, 3,756,866, 3,206,338, 3,494,760, 3,535,104, 3,567,525, 3,661,556, 3,663,318, 3,669,643, 3,672,867, and 3,726,664 and Japanese Patent application Nos. 91498/73, 92720/73, 106901/74 and 134467/73); and (6) particles of a ferromagnetic metal are electrodeposited on a mercury cathode from which the particles are then separated (see Japanese Patent Publication Nos. 12910/60, 3860/61, 5513/61, 787/64, 15525/64 and 8123/65, and U.S. Pat. Nos. 3,262,812, 3,198,717 and 3,156,650).

The invention relates to a method for preparing ferromagnetic metal particles in accordance with the above method (2).

Coercive force (Hc) of ferromagnetic metal particles generally depends upon the anisotropy of the acicular shape of particles, and it is important to maintain the acicular shape. However, there is a problem with method (2) in that as reduction is carried out in a hydrogen gas at a high temperature, so sintering easily occurs in the reducing step. In order to eliminate this problem, there has been proposed in Japanese Patent application (OPI) No. 63605/82 a method which comprises attaching or adsorbing a compound which is capable of preventing sintering on the surface of acicular iron oxyhydroxide particles, then dehydrating acicular iron oxyhydroxide particles in a non-reducing gas under heating and reducing the resulting acicular iron oxide particles in a reducing gas under heating.

However, since the compound attached on the surface of iron oxyhydroxide particles comes into the inside of iron oxyhydroxide particles in some amount, an acicular shape can hardly be maintained. Accordingly, the shape of thus prepared metal particle is readily broken. Further the crystal size of the skeltone is large and thus its specific surface area is small. The noise level of signals of a magnetic recording medium using ferromagnetic metal particles having a large crystal size is high. Therefore the large crystal size is not preferred.

SUMMARY OF THE INVENTION

An object of this invention is to provide ferromagnetic metal particles having a good acicular shape.

Another object of the invention is to provide ferromagnetic metal particles having a large specific surface area.

As a result of extensive research, the inventors found that where oxyhydroxide particles mainly composed of iron are dehydrated under heating in a non-reducing gas at considerably low temperature, oxide particles mainly composed of iron having a small crystal size can be obtained, and that ferromagnetic metal particles having a large specific surface area can be obtained without sintering and without deteriorating the acicular shape by dehydrating oxyhydroxide particles comprised mainly of iron in a non-reducing gas under heating at a temperature of 500° C. or less to form oxide particles, providing a silicon compound on the surface of the oxide particles and reducing the oxide particles in a reducing gas under heating.

DETAILED DESCRIPTION OF THE INVENTION

An acicular iron oxyhydroxide particles employed in the invention can be obtained in a conventional manner by neutralizing an aqueous solution of ferrous salt or an aqueous solution containing a mixture of ferrous salt and ferric salt with an alkaline agent and oxidizing it with oxidizing gas, as described in, for example, M. Kiyama, *Bulletin of the Chemical Society of Japan,* 47, 1646 (1974). If necessary, a metal other than iron (e.g., Ti, V, Cr, Mn, Co, Ni, Cu, Zn, Si, P, Mo, Sn, Sb, Ag, etc.) can be added in an amount of 0 to 40 atomic % based on the total metal components (i.e. iron + the other metal component). These metals can be added alone or in combination before, during or after the above reaction. The acicular iron oxyhydroxide particles preferably have a size of 0.1 to 2 μm, more preferably 0.15 to 1.0 μm and most preferably 0.2 to 0.5 μm and an acicular ratio of 2/1 to 50/1, more preferably 5/1 to 40/1 and most preferably 10/1 to 30/1.

In this invention, oxyhydroxide particles composed mainly of iron (Fe: more than 60 atomic %, preferably than 80 atomic % based on the total metal components) are heated and dehydrated in a non-reducing gas at a temperature of not higher than 500° C. Examples of the non-reducing gas include an inert gas such as $N_2$ and He, and an oxidizing gas such as air and water vapor. The above mentioned iron oxyhydroxides generally start to be dehydrated at a temperature of not lower than about 250° C. The specific surface area of thus prepared oxide particles mainly composed of iron depends upon the temperature of dehydration. The lower the temperature is, the larger the specific surface area is and the more pores the thus prepared oxide particles have. As mentioned hereinafter in the examples, the specific surface area of oxide particles is closely related to the specific surface area of ferromagnetic metal particles as a final product. Therefore, where the temperature at the process of dehydration is high, the effects obtained with this invention are insufficient. In order to obtain the effects of the invention, the temperature of dehydration is not higher than 500° C., more preferably not higher than 400° C. and most preferably 300° to 400° C. The dehydration is generally performed for more than 30 minutes, preferably 1 to 4 hours and more preferably 2 to 3 hours. The specific surface area of thus prepared oxide particles measured by BET method ($N_2$ gas adsorption method) is generally not less than 50 $m^2/g$, preferably not less than 70 $m^2/g$ and more preferably not less than 100 $m^2/g$.

Next, the oxide particles having a large specific surface area are then attached to silicon compound. Examples of the silicon compound includes water-soluble silicon compounds such as silicates (so-called water glass, e.g., $Na_2SiO_3$ and $Na_2Si_2O_5$), silicon hydroxides (e.g., $Si(OH)_4$) and silicon oxides (e.g., silica), with $Na_2SiO_3$ and colloidal silica being preferred. The silicon compound can be attached by, for example, mixing a solution containing the silicon compound with an aqueous dispersion of the oxide particles. The resulting mixture is preferably neutralized, whereby the silicon compound is sufficiently attached on the oxide particles. The amount of silicon compounds is generally 0.5 to 12 atomic % based on the total metal components in oxide particles, but it depends upon the specific surface area of the oxide particles and the kinds of additives included in iron oxyhydroxide particles. Especially, the larger the specific surface area of oxide particles is, the greater the amount of silicon compounds should be. Further, when oxide particles do not include Ni or Cu as the additives, the amount of silicon compound is preferably 1 to 3 atomic % where the oxide particles have a specific surface area of 50 $m^2/g$ and it is preferably 3 to 5 atomic % where the oxide particles have a specific surface area of 120 $m^2/g$. On the other hand, when oxide particles include Ni or Cu, the amount of silicon compound is preferably 8 to 10 atomic % where the oxide particles have a specific surface area of 50 $m^2/g$ and it is preferably 10 to 12 atomic % where the oxide particles have a specific surface area of 120 $m^2/g$.

In this invention, the oxides treated with silicon compounds are heated and reduced in a reducing gas such as $H_2$ gas at a temperature of 300° to 550° C., preferably 350° to 520° C., more preferably 370° to 480° C., for more than 1 hour, preferably more than 2 hours, more preferably more than 3 hours, whereby ferromagnetic metal particles are produced.

It is preferred that the reducing temperature be low in order to prevent sintering. However, if the temperature is too low, the reduction proceeds very slowly and can not be finished within a predetermined period. Particularly where oxides are treated with much silicon compounds, there is a tendency to prevent reduction. Therefore, it is necessary to keep the reducing temperature high. As a result, where silicon compounds are used in a large amount (generally more than 5 atomic % based on the total metal components), the temperature can become too high and sintering readily occurs. In the case, however, by incorporating at least one of Ni or Cu into iron oxyhydroxide particles as described above reduction can proceed even at a low temperature and oxide particles treated with much silicon compounds can be readily reduced. For the purpose, the amount of Ni or Cu incorporated is preferably 3 to 20 atomic %, more preferably 5 to 10 atomic %, based on the total metal components in iron oxyhydroxide. If the amount is less than 3 atomic %, the effect obtained is not sufficient. If the amount is more than 20 atomic %, the $\sigma$s of thus produced ferromagnetic metal particles is decreased.

In accordance with the method of the invention, ferromagnetic metal particles having more unbreakable skeltone than particles prepared by a conventional method and having a large specific surface area can be obtained. The reason for this is believed to be as follows.

Where iron oxyhydroxide particles are coated with silicon compounds and then dehydrated in a non-reducing gas at a high temperature, silicon compounds residing on the surface of oxyhydroxide particles diffuse into the inside of oxyhydroxide particles at the dehydration step, as is done in a conventional method. Accordingly, the effect of preventing sintering on the surface of oxide particles is decreased at the starting point of reduction. On the other hand, in the invention, oxide particles are coated with silicon compounds after oxyhydroxide particles are dehydrated. Therefore, the effect of preventing sintering is much larger than with a conventional method at the starting point of reduction. Accordingly, the shape of oxides after dehydration can be kept until the oxides become metal particles. Metal particles having a large specific surface area can be obtained from oxides which are dehydrated even at a low temperature.

Ferromagnetic metal particles thus produced by the invention have a specific surfaces area of not less than 30 $m^2/g$, preferably not less than 50 $m^2/g$, more preferably not less than 70 $m^2/g$ and an acicular ratio of not less than 5/1, preferably not less than 10/1, more preferably not less than 15/1.

The thus produced ferromagnetic metal particles are used in a conventional manner to produce a magnetic recording medium such as a magnetic tape or sheet. For example, the ferromagnetic metal particles are blended with conventional binders, additives and solvents and dispersed by a conventional method. The resulting dispersion is applied to a non-magnetic base to produce a magnetic recording medium. The binders, additives, solvents and non-magnetic base and the process for producing the magnetic recording medium are described in Japanese Patent Publication No. 26890/81 and U.S. Pat. No. 4,135,016.

This invention will be explained in further detail by the following examples. However, the scope of the invention is not limited to these examples. In the Examples, "part" means "part by weight".

EXAMPLE 1

α-FeOOH having a length of 0.4 μm and an acicular ratio of 20/1 was heated and dehydrated in a nitrogen gas at 300° C. for 2 hours to prepare acicular $\alpha$-$Fe_2O_3$ particles (Sample R-1). 100 g of the thus prepared particles were suspended in 2 liters of water and were added with an aqueous solution of sodium silicate at the Si/Fe ratio of 3 atomic % while stirring, and after further stirring for 1 hour, the slurry was filtrated, washed with water and dried. Thus obtained particles were reduced in a hydrogen gas at 440° C. for 6 hours to prepare ferromagnetic metal particles (Sample B-1).

EXAMPLE 2

The same procedure as in Example 1 was repeated except that the dehydration temperature was 500° C. to prepare $\alpha$-$Fe_2O_3$ particles (Sample R-2) and ferromagnetic metal particles (Sample B-2).

COMPARATIVE EXAMPLE 1

The same procedure as in Example 1 was repeated except that the dehydration temperature was 700° C. to prepare $\alpha$-$Fe_2O_3$ particles (Sample R-3) and ferromagnetic metal particles (Sample B-3).

COMPARATIVE EXAMPLE 2

100 g of α-FeOOH which is the same as that used in Example 1 was sufficiently suspended in 2 liters of water and added to an aqueous solution of sodium silicate at the Si/Fe ratio of 3 atomic % while stirring. After further stirring for 1 hour, the slurry was filtrated, washed with water and dried. Thus obtained particles were heated and dehydrated in a nitrogen gas at 300° C. for 2 hours to obtain $\alpha$-$Fe_2O_3$ containing Si (Sample R-4), which was further reduced in a hydrogen gas at 440° C. for 6 hours to prepare ferromagnetic metal particles (Sample B-4).

COMPARATIVE EXAMPLE 3

The same procedure as in Comparative Example 2 was repeated except that the dehydration temperature was 500° C. to prepare $\alpha$-$Fe_2O_3$ particles (Sample R-5) and ferromagnetic metal particles (Sample B-5).

COMPARATIVE EXAMPLE 4

The same procedure as in Comparative Example 2 was repeated except that the dehydration temperature was 700° C. to prepare $\alpha$-$Fe_2O_3$ particles (Sample R-6) and ferromagnetic metal particles (Sample B-6).

EXAMPLE 3

α-FeOOH doped with 7 atomic % Ni, having an average particle length of 0.4 μm and an acicular ratio of 20/1 was heated and dehydrated in a nitrogen gas at 300° C. for 1 hour to prepare Ni-containing $\alpha$-$Fe_2O_3$ particles (Sample R-7). 100 g of the particles were suspended in 2 liters of water, and an aqueous solution of sodium silicate was added thereto at the Si/(Fe+Ni) ratio of 10 atomic % while stirring. After stirring for one hour, the slurry was filtrated, washed with water and dried. Thus obtained particles were reduced in a hydrogen gas at 420° C. for 6 hours to prepare ferromagnetic metal particles (Sample B-7).

Further, the same procedure as above was repeated except that α-FeOOH doped with 6 atomic % Cu, having an average particle length of 0.4 μm and an acicular ratio of 20/1 was used to prepare Cu-containing $\alpha$-$Fe_2O_3$ particles (Sample R-8) and ferromagnetic metal particles (Sample B-8).

Furthermore, the same procedure as above was repeated except that α-FeOOH (non-doped) having an average particle length of 0.4 μm and an acicular ratio of 20/1 was used to prepare $\alpha$-$Fe_2O_3$ particles (Sample R-9) and the particles were reduced in a hydrogen gas at 520° C. for 6 hours to prepare ferromagnetic metal particles (Sample B-9).

The characteristics of thus obtained samples were shown in Table 1.

In the table, the specific surface area was measured by BET method (nitrogen gas adsorption method). Magnetic characteristics were measured by a sample-vibration type flux meter at Hmax=10 kOe.

TABLE 1

| | Samples | | | | | | | | |
|---|---|---|---|---|---|---|---|---|---|
| | $\alpha$-$Fe_2O_3$ | Metal particles | Dehydrating temp. (°C.) | Specific surface area of $\alpha$-$Fe_2O_3$ ($m^2/g$) | Amount of Si (atomic %)* | Reducing temp. (°C.) | Specific surface area of metal particles ($m^2/g$) | Hc (Oe) | σs (emu/g) |
| Example 1 | R-1 | B-1 | 300 | 105 | 3.0 | 440 | 76 | 1430 | 142 |
| Example 2 | R-2 | B-2 | 500 | 67 | 3.0 | 440 | 50 | 1450 | 145 |
| Comp. Example 1 | R-3 | B-3 | 700 | 40 | 3.0 | 440 | 31 | 1380 | 142 |
| Comp. Example 2 | R-4 | B-4 | 300 | 112 | 3.0 | 440 | 31 | 1370 | 143 |
| Comp. Example 3 | R-5 | B-5 | 500 | 83 | 3.0 | 440 | 36 | 1380 | 135 |
| Comp. Example 4 | R-6 | B-6 | 700 | 52 | 3.0 | 440 | 32 | 1380 | 145 |
| Example 3 | R-7 | B-7 | 300 | 108 | 10.0 | 420 | 78 | 1330 | 142 |
| | R-8 | B-8 | 300 | 108 | 10.0 | 420 | 80 | 1310 | 143 |
| | R-9 | B-9 | 300 | 105 | 10.0 | 520 | 38 | 880 | 112 |

*based on the total metal components

It is clearly seen from the results of Examples 1 to 2 and Comparative Examples 1 to 4 in Table 1 that ferromagnetic metal particles having much larger specific surface areas and much higher coercive force can be obtained in accordance with the method of the invention than the particles obtained by the conventional method. It is also apparent from the results of Example 3 that iron oxyhydroxide particles containing Ni or Cu and having a large amount of silicon compounds coated thereon (Samples R-7 and R-8) are readily reduced, whereas those containing no Ni or Cu and having a large amount of silicon compounds (Sample R-9) provide metal particles having low $\sigma s$ and Hc even though they were heated at 520° C.

EXAMPLE 4

300 parts of Sample B-1 and the following composition were mixed, kneaded and dispersed sufficiently in a ball mill.

| | |
|---|---|
| Copolymer of vinyl chloride and vinyl acetate ("VMCH" manufactured by U.C.C.) | 30 parts |
| Polyurethane resin ("Estane 5701") manufactured by Goodrich Co., Ltd.) | 20 parts |
| Dimethyl polysiloxane (Polymerization degree: about 60) | 6 parts |
| Butyl acetate | 600 parts |
| Methyl isobutyl ketone | 300 parts |

After dispersion, 25 parts of 75 wt. % ethyl acetate solution of triisocyanate compound ("Desmodule L-75") manufactured by Bayer A.G. ) was added thereto and dispersed for 1 hour with high speed shearing force to prepare a magnetic coating composition. The obtained magnetic coating composition was coated on a polyester film in a dry thickness of 4 $\mu$m, subjected to magnetic orientation, surface treated after drying and slit to a predetermined width to obtain a magnetic tape (Magnetic tape 1).

COMPARATIVE EXAMPLE 5

The same procedure as in Example 4 was repeated except using Sample B-3 to prepare a magnetic tape (Magnetic tape 2).

Magnetic tapes 1 and 2 were erased by an erasure apparatus (bulk erasure) and mounted on an audio cassette deck to measure noise levels. The noise level of the magnetic tape 1 was −3.5 dB, assuming that the noise level of the magnetic tape 2 was 0 db. It is apparent from the above that the noise of the magnetic tape prepared using ferromagnetic metal particles of this method is remarkably low in comparison with the conventional tape even though the same goethite was used as a starting material therebetween.

While the invention has been described in detail and with reference to specific embodiments thereof, it will be apparent to one skilled in the art that various changes and modifications can be made therein without departing from the spirit and scope thereof.

What is claimed is:

1. A method for preparing ferromagnetic metal particles, comprising the steps of:

dehydrating oxyhydroxide particles comprised mainly of iron in a non-reducing gas under heating at a temperature of 500° C. or less to form oxide particles;

providing silicon compounds on the surface of the oxide particles; and then reducing the oxide particles in a reducing gas under heating.

2. A method for preparing ferromagnetic metal particles as claimed in claim 1, wherein the oxyhydroxide particles are further comprised of a metal other than iron selected from the group consisting of Ti, V, Cr, Mn, Co, Ni, Cu, Zn, Si, P, Mo, Sn, Sb and Ag.

3. A method for preparing ferromagnetic metal particles as claimed in claim 2, wherein the metal other than iron is selected from the group consisting of Ni and Cu.

4. A method for preparing ferromagnetic metal particles as claimed in claim 1, wherein the oxyhydroxide particles are acicular iron oxyhydroxide particles having a size in the range of 0.1 to 2 $\mu$m.

5. A method for preparing ferromagnetic metal particles as claimed in claim 4, wherein the acicular iron oxyhydroxide particles have an acicular ratio of 2/1 to 50/1.

6. A method for preparing ferromagnetic metal particles as claimed in claim 1, wherein the dehydrating of the oxyhydroxide particles is carried out at a temperature in the range of 300° to 400° C.

7. A method for preparing ferromagnetic metal particles as claimed in claim 1, wherein the silicon compounds are provided on the oxide particles in an amount of 0.5 to 12 atomic % based on the total metal components in the oxide particles.

8. A method for preparing ferromagnetic metal particles as claimed in claim 7, wherein the silicon compounds are water-soluble silicon compounds selected from the group consisting of silicates, silicon hydroxides and silicon oxides.

9. A method for preparing ferromagnetic metal particles as claimed in claim 1, wherein the reducing of the oxide particles is carried out at a temperature in the range of 300° to 550° C.

10. A method for preparing ferromagnetic metal particles as claimed in claim 1, wherein the oxyhydroxide particles are further comprised of 3 to 20 atomic % of a metal selected from the group consisting of Ni and Cu based on the total metal components in the oxyhydroxide particles.

* * * * *